US007255078B2

(12) United States Patent
Yoshijima et al.

(10) Patent No.: US 7,255,078 B2
(45) Date of Patent: Aug. 14, 2007

(54) RESIN CYLINDER HEAD COVER

(75) Inventors: Kazuya Yoshijima, Okazaki (JP); Akihiro Osaki, Okazaki (JP); Hidemi Kato, Aichi (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/191,064

(22) Filed: Jul. 28, 2005

(65) Prior Publication Data

US 2006/0027199 A1 Feb. 9, 2006

(30) Foreign Application Priority Data

Aug. 4, 2004 (JP) ..... 2004-228569

(51) Int. Cl.
*F01M 9/10* (2006.01)

(52) U.S. Cl. ..... 123/90.38; 123/90.15; 123/90.17

(58) Field of Classification Search ..... 123/90.38, 123/90.15, 90.17, 90.31
See application file for complete search history.

(56) References Cited

U.S. PATENT DOCUMENTS

| | | | | |
|---|---|---|---|---|
| 6,035,817 | A * | 3/2000 | Uchida | 123/90.17 |
| 2003/0145814 | A1 * | 8/2003 | Inoue | 123/90.17 |

FOREIGN PATENT DOCUMENTS

| | | |
|---|---|---|
| JP | A-55-161941 | 12/1980 |
| JP | B2 3525709 | 5/1999 |
| JP | A 2003-232260 | 8/2003 |
| WO | WO 2004/035245 A1 | 4/2004 |

* cited by examiner

*Primary Examiner*—Thomas Denion
*Assistant Examiner*—Zelalem Eshete
(74) *Attorney, Agent, or Firm*—Oliff & Berridge, PLC

(57) ABSTRACT

A resin cylinder head cover for an internal combustion engine includes a resin cover main body and a resin oil passage that is integrated with the cover main body. As a result, the problems of increase in the number of components and deterioration of the oil sealing performance in a resin cylinder head cover are solved.

15 Claims, 16 Drawing Sheets

RESIN CYLINDER HEAD COVER

BACKGROUND OF THE INVENTION

The present invention relates a resin cylinder head cover of an internal combustion engine.

Apparatuses for adjusting valve timing using a variable valve actuation mechanism are known in the art (for example, Japanese Patent No. 3525709). Such an apparatus includes a hydraulically operated variable valve actuation mechanism provided at a timing sprocket or a timing pulley of an internal combustion engine, and hydraulic pressure supplying oil passages formed in the camshaft. The apparatus uses an oil control valve for driving the variable valve actuation mechanism through the hydraulic pressure supplying oil passages.

In such an apparatus, a valve case is attached to insertion holes formed in the upper portion of the cylinder head cover. The oil control valve is inserted in and secured to the valve case. To supply oil to the oil control valve through the cylinder head cover, metal pipes are provided on the outer surface or the inner surface of the cylinder head cover to define oil passages. A union bolt is attached to each end of each metal pipe, so that the oil passages of the cylinder head cover, which are at the oil supplying side; are connected to the oil passages at the side of the oil control valve.

Since the oil passages of the metal cylinder head cover are defined by metal pipes in Japanese Patent No. 3525709, the metal pipes need to be supported in a raised state from the surface of the cylinder head cover by using union bolts, oil joints, and other supporting members.

This increases the number of metal components and thus increases the weight. Further, resonance due to the operation of the internal combustion engine is likely to degrade the oil sealing performance of the union bolts and the oil joints.

To reduce the weight and the noise level, the use of resin for forming cylinder head covers have been studied. However, as described above, if metal pipes are used for oil passages, the use of resin cannot solve the problems of increase in the number of components and deterioration of the oil sealing performance.

SUMMARY OF THE INVENTION

Accordingly, it is an objective of the present invention to solve the problems of increase in the number of components and deterioration of the oil sealing performance in a resin cylinder head cover.

To achieve the foregoing and other objectives and in accordance with the purpose of the present invention, a resin cylinder head cover for an internal combustion engine is provided. The cylinder head cover includes a resin cover main body and a resin oil passage that is integrated with the cover main body.

Other aspects and advantages of the invention will become apparent from the following description, taken in conjunction with the accompanying drawings, illustrating by way of example the principles of the invention.

BRIEF DESCRIPTION OF THE SEVERAL VIEWS OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

First Embodiment

FIGS. 1(A) and 1(B) are perspective views illustrating a resin cylinder head cover 2 according to the present invention. FIG. 1(A) shows the outer side of the cylinder head cover 2, and FIG. 1(B) shows an inner side of the resin cylinder head cover 2. An internal combustion engine to which the resin cylinder head cover 2 is applied is capable of adjusting the valve timing of intake valves and the exhaust valves.

Figure 2:
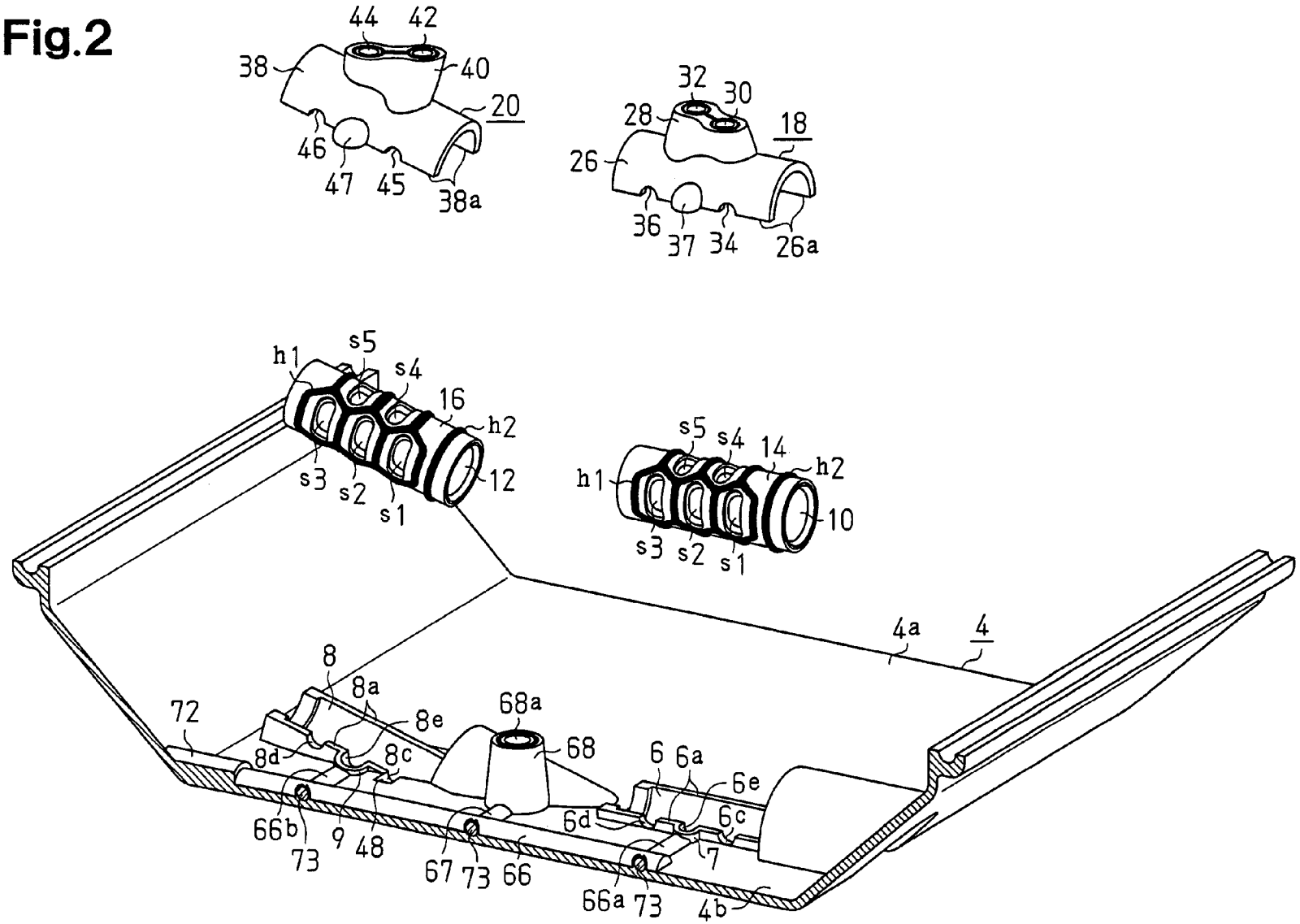
FIG. 2 is an exploded perspective view illustrating the resin cylinder head cover of the first embodiment.

As shown in the exploded perspective view of the FIG. 2, the resin cylinder head cover 2 includes sleeves 10, 12, rubber cylindrical gaskets 14, 16, and a cylinder head cover main body 4 having cradles 6, 8. Each of the sleeves 10, 12 is assembled with one of the cylindrical gaskets 14, 16. Each assembly is arranged in one of the cradles 6, 8. Resin caps 18, 20 are welded to edges 6*a*, 8*a* of the cradles 6, 8. Accordingly, the assembled sleeves 10, 12 and the cylindrical gaskets 14, 16 are fixed to the cradles 6, 8. The cylinder head cover main body 4 is formed of resin by integral molding.

Figure 3:
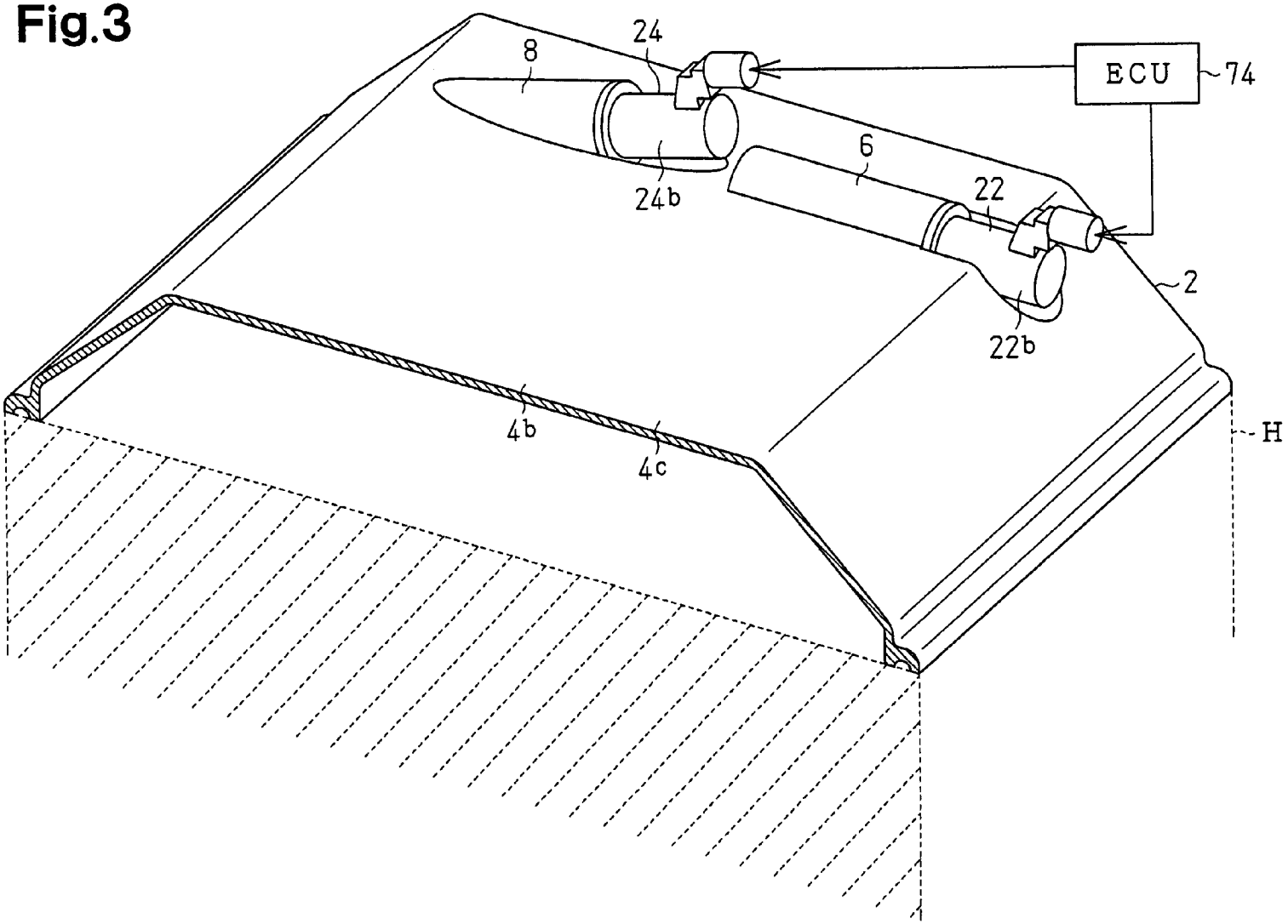
FIG. 3 is a perspective view illustrating the resin cylinder head cover of the first embodiment when attached to a cylinder head.

After the above described resin cylinder head cover 2 is attached to a cylinder head H as shown in FIG. 3, oil control valves (hereinafter referred to as OCV) 22, 24 are attached to the sleeves 10, 12 fixed to the cradles 6, 8 on an inner surface 4*a* of the cylinder head cover main body 4 (FIG. 2). Specifically, the OCV 22 for adjusting the valve timing of the intake valves is attached to the first sleeve 10 in the first cradle 6, and the OCV 24 for adjusting the valve timing of the exhaust valves is attached to the second sleeve 12 in the second cradle 8.

Figure 1:
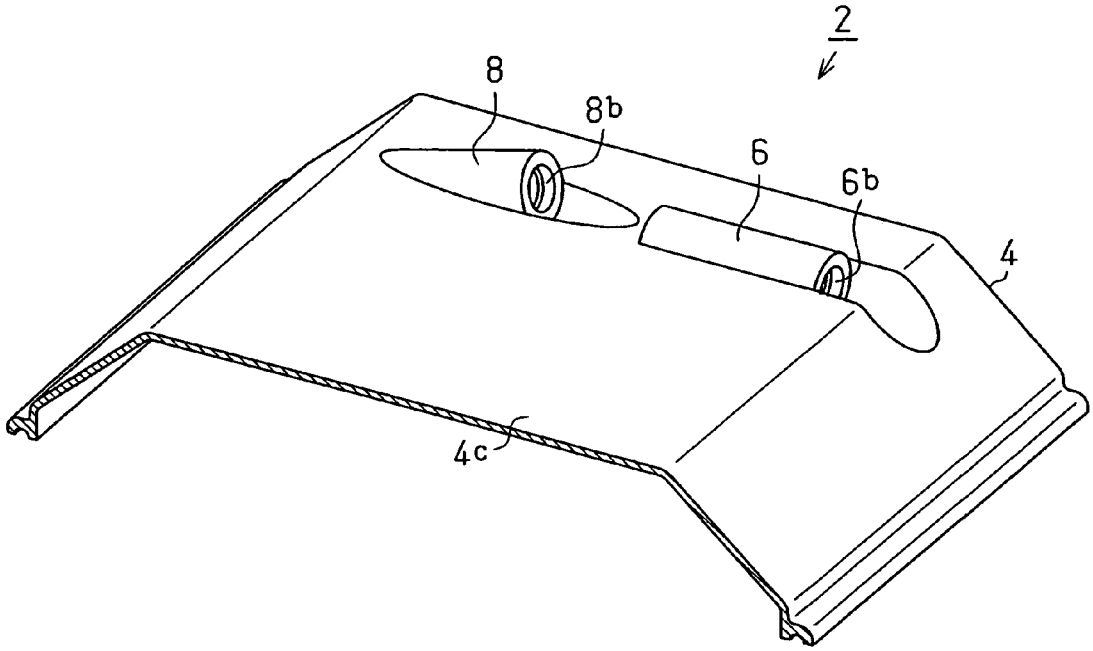
FIG. 1(A) is a perspective view illustrating the top of a resin cylinder head cover according to a first embodiment.
FIG. 1(B) is a perspective view illustrating the bottom of the resin cylinder head cover of the first embodiment.
Figure 1:
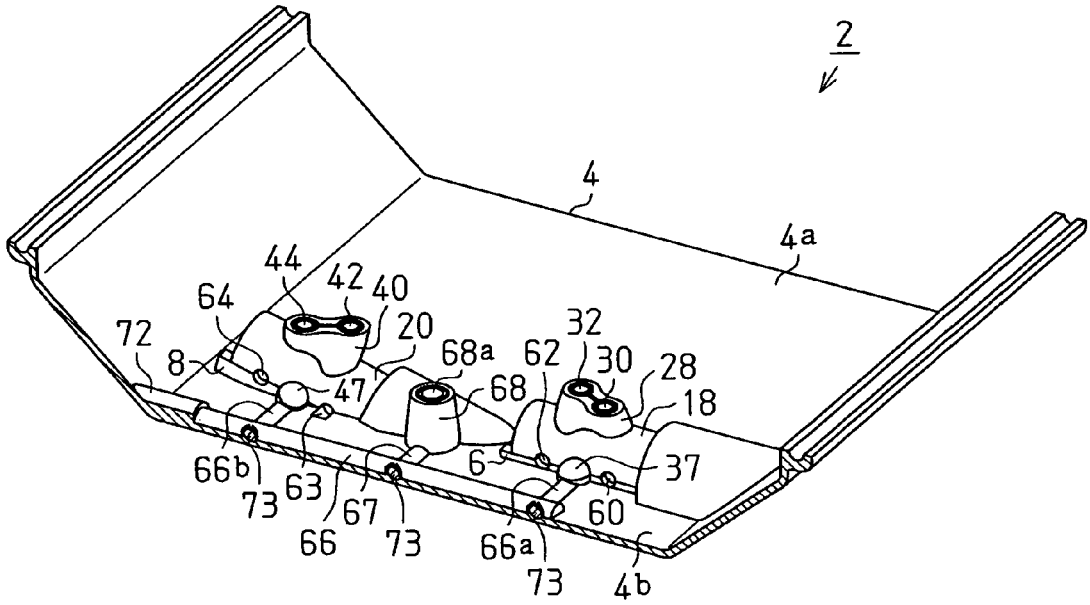

As shown in FIGS. 1 and 2, the first cradle 6 has a semi-cylindrical shape and is arranged such that its axial direction is perpendicular to the axial direction of an intake camshaft 52 (see FIG. 8), and parallel to a top surface 4*b* of the cylinder head cover main body 4. Further, a part of the distal end of the first cradle 6 is open to an outer surface 4*c* of the cylinder head cover main body 4 to form an insertion opening portion 6*b*.

The second cradle 8 substantially has the same shape as the first cradle 6. That is, the second cradle 8 has a semi-cylindrical shape and is arranged such that its axial direction is perpendicular to the axial direction of an exhaust camshaft 56 (see FIG. 8). However, unlike the first cradle 6, the second cradle 8 is inclined relative to the top surface 4*b* so that an insertion opening portion 8*b* faces upward in a slanted manner. The insertion opening portion 8*b* is formed in the outer surface 4*c* of the cylinder head cover main body 4 to receive the OCV 24.

Figure 4:
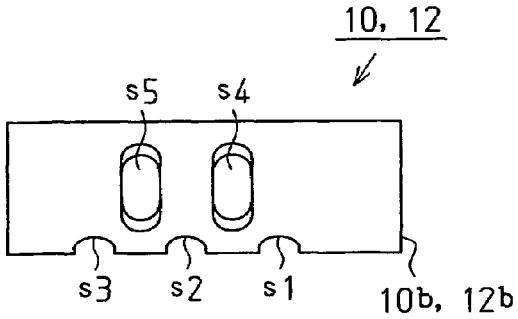
FIG. 4(A) is a plan view illustrating a sleeve according to the first embodiment.
FIG. 4(B) is a front view illustrating the sleeve of FIG. 4(A)
FIG. 4(C) is a bottom view illustrating the sleeve of FIG. 4(A)
FIG. 4(D) is a perspective view illustrating the sleeve of FIG. 4(A)
FIG. 4(E) is a left side view illustrating the sleeve of FIG. 4(A)
FIG. 4(F) is a right side view illustrating the sleeve of FIG. 4(A)
Figure 4:
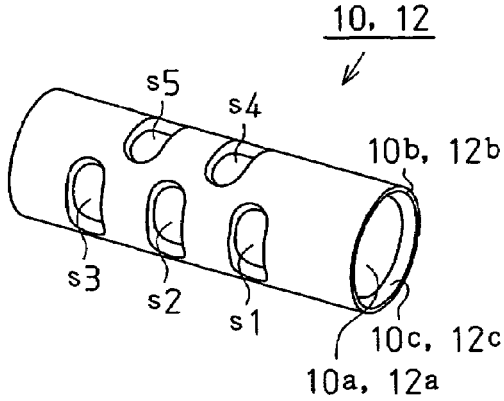
Figure 4:
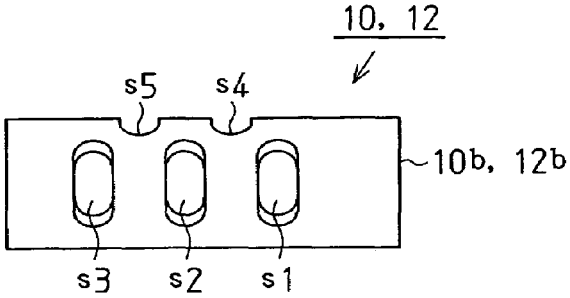
Figure 4:
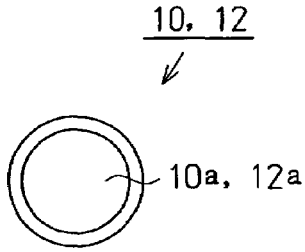
Figure 4:
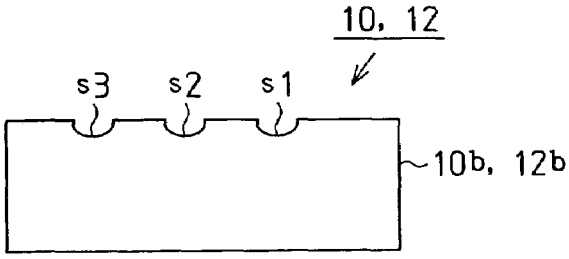
Figure 4:
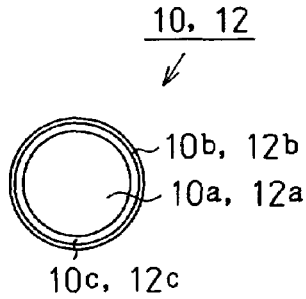

The first resin cap 18 attached to the first cradle 6 is formed of resin (the same resin as that of the cylinder head cover main body 4 in this embodiment) by integral molding, and includes a semi-cylindrical main body 26 and a coupling portion 28. Intermediate oil passages 30, 32 are formed in a top portion of the cap main body 26 and extend through the coupling portion 28. The intermediate oil passages 30, 32 correspond to oil holes s4, s5 shown in FIG. 4 formed in the cylindrical first sleeve 10, which is made of metal. The metal of the first sleeve 10 is an aluminum base alloy in this embodiment. The intermediate oil passages 30, 32 are formed in the coupling portion 28. The intermediate oil passages 30, 32 are either curved or formed linearly in a slanted manner. At the distal end of the coupling portion 28, the intermediate oil passages 30, 32 are displaced from each other with respect to a circumferential direction of the cap main body 26.

Since the first sleeve 10 is identical with the second sleeve 12, a single set of drawings of FIGS. 4(A) to 4(F) is used for describing both of the first and second sleeves 10, 12. FIG. 4(A) is a plan view, FIG. 4(B) is a front view, FIG. 4(C) is a bottom view, FIG. 4(D) is a perspective view, FIG. 4(E) is left side view, and FIG. 4(F) is a right side view.

The sleeves 10, 12 will now be described. The sleeves 10, 12 are made of metal and have a cylindrical shape. The metal forming sleeves 10, 12 substantially has the same coefficient of thermal expansion as material forming spool housings 22*a*, 24*a* of the OCVs 22, 24 shown in FIG. 8. More specifically, the sleeves 10, 12 are formed of aluminum base alloy. The sleeves 10, 12 may be formed of exactly the same metal as that of the spool housings 22*a*, 24*a* of the OCVs 22, 24.

Each of the sleeves 10, 12 has oil holes s1, s2, s3, s4, s5, which extend from inner mounting bores 10*a*, 12*a* toward the outside. The oil holes s1, s2, s3, s4, s5 correspond to five ports p1, p2, p3, p4, p5 formed in the spool housings 22*a*, 24*a* of the OCVs 22, 24. Tapered surfaces 10*c*, 12*c* are formed on the inner sides of insertion ends 10*b*, 12*b* of the sleeves 10, 12 for facilitating the attachment of the OCVs 22, 24.

As shown in FIG. 2, the cylindrical gaskets 14, 16, which surround the circumferential surface of the sleeves 10, 12, each have through holes corresponding to the oil holes s1 to s5 of the sleeves 10, 12. On the outer circumferential surface of each of the cylindrical gaskets 14, 16, a mesh-like projection h1 is formed to surround the through holes. Further, a projection h2 is formed on the entire circumference of each of the cylindrical gaskets 14, 16 near the end for receiving the corresponding one of the OCVs 22, 24. Although the projections h1, h2 are shown as solid filled portions in the drawings, the projections h1, h2 are formed of rubber by integral molding with the cylindrical gaskets 14, 16.

When the assembly of the sleeves 10, 12 and the cylindrical gaskets 14, 16 are held between the cradles 6, 8 and the resin caps 18, 20, the projections h1 seal the oil holes s1 to s5 between the outer circumferential surfaces of the sleeves 10, 12 and the inner circumferential surfaces of the cradles 6, 8 and resin caps 18, 20. Further, the projections h2 seal the interior of the cylinder head cover main body 4 from the outside.

The length of the cradles 6, 8 is the same as that of the sleeves 10, 12. The diameter of the cradles 6, 8 is slightly less than the diameter of the assemblies of the sleeves 10, 12 and the cylindrical gaskets 14, 16. Therefore, the assemblies of the sleeves 10, 12 and the cylindrical gaskets 14, 16 are inserted into the cradles 6, 8 while pressing the projections h1, h2 of the cylindrical gaskets 14, 16. The assemblies of the sleeves 10, 12 and the cylindrical gaskets 14, 16 are thus arranged in the cradles 6, 8.

The resin caps 18, 20 are welded to the cradles 6, 8 such that the assemblies of the sleeves 10, 12 and the cylindrical gaskets 14, 16 are held between the resin caps 18, 20 and the cradles 6, 8. Accordingly, as shown in FIGS. 1 and 3, the resin cylinder head cover 2, which is capable of receiving the OCVs 22, 24, is completed.

Two semicircular notches 34, 36 are formed in one of the edges 26*a* of the cap main body 26 of the first resin cap 18. When the edges 26*a* of the first resin cap 18 contact the edges 6*a* of the first cradle 6, the notches 34, 36 form draining oil passages 60, 62 (FIG. 1) together with notches 6*c*, 6*d* formed in one of the edges 6*a* of the first cradle 6. The draining oil passages 60, 62 correspond to the oil holes s1, s3 of the first sleeve 10, and are designed for draining hydraulic oil to the interior of the resin cylinder head cover 2.

Figure 5:
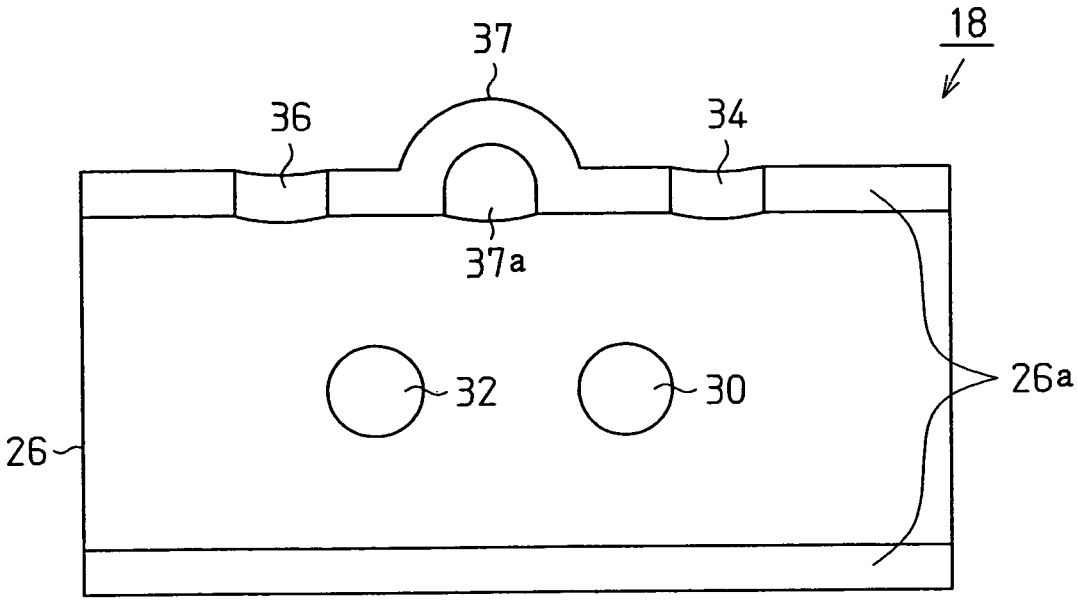
FIG. 5 is a bottom view illustrating a first resin cap according to the first embodiment.

A projection 37 is formed to project from the outer circumferential surface between the two notches 34, 36 as shown in FIG. 5, which illustrates the bottom view of the first resin cap 18. A supply recess 37*a* is formed inside the projection 37. A projection 7 is formed in the first cradle 6, and a supply recess 6*e* is formed in the projection 7 (see FIG. 2). The supply recess 37*a*, together with the supply recess 6*e*, receives hydraulic pressure.

The second resin cap 20 attached to the second cradle 8 has substantially the same structure as the first resin cap 18. That is, the second resin cap 20 is formed of resin (in this embodiment, the same resin as that of the cylinder head cover main body 4) by integral molding, and includes a semicylindrical cap main body 38 and a coupling portion 40. Intermediate oil passages 42, 44 are formed in a top portion of the cap main body 38 and extend through the coupling portion 40. The intermediate oil passages 42, 44 correspond to oil holes s4, s5 shown in FIG. 4 formed in the second sleeve 12. The intermediate oil passages 42, 44 are formed in the coupling portion 40. The intermediate oil passages 42, 44 are either curved or formed linearly in a slanted manner. At the distal end of the coupling portion 40, the intermediate oil passages 42, 44 are displaced from each other with respect to a circumferential direction of the cap main body 38.

Two semicircular notches 45, 46 are formed in one of the edges 38*a* of the cap main body 38 of the second resin cap 20. When the edges 38*a* of the second resin cap 20 contact the edges 8*a* of the second cradle 8, the notches 45, 46 form draining oil passages 63, 64 (FIG. 1) together with notches 8*c*, 8*d* formed in one of the edges 8*a* of the second cradle 8. The draining oil passages 63, 64 correspond to the oil holes s1, s3 of the second sleeve 12, and drain hydraulic oil to the interior of the resin cylinder head cover 2. The combination of the notch 45 of the second resin cap 20 and the notch 8*c* of the second cradle 8 would be embedded in the cylinder head cover main body 4, and would not be capable of draining hydraulic oil into the interior of the resin cylinder head cover 2. Therefore, a draining recess 48 is formed.

Figure 6:
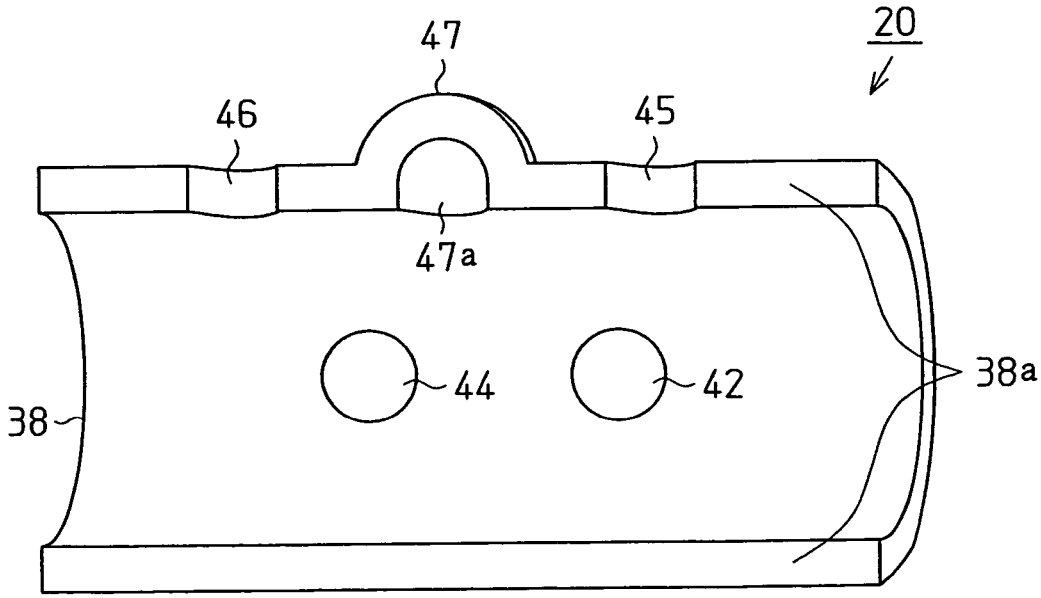
FIG. 6 is a bottom view illustrating a second resin cap according to the first embodiment.

A projection 47 is formed to project from the outer circumferential surface between the two notches 45, 46 as shown in FIG. 6, which illustrates the bottom view of the second resin cap 20. A supply recess 47*a* is formed inside the projection 47. A projection 9 is formed in the second cradle 8, and a supply recess 8*e* is formed in the projection 9 (see FIG. 2). The supply recess 47*a*, together with the supply recess 8*e*, receives hydraulic pressure.

Figure 7:
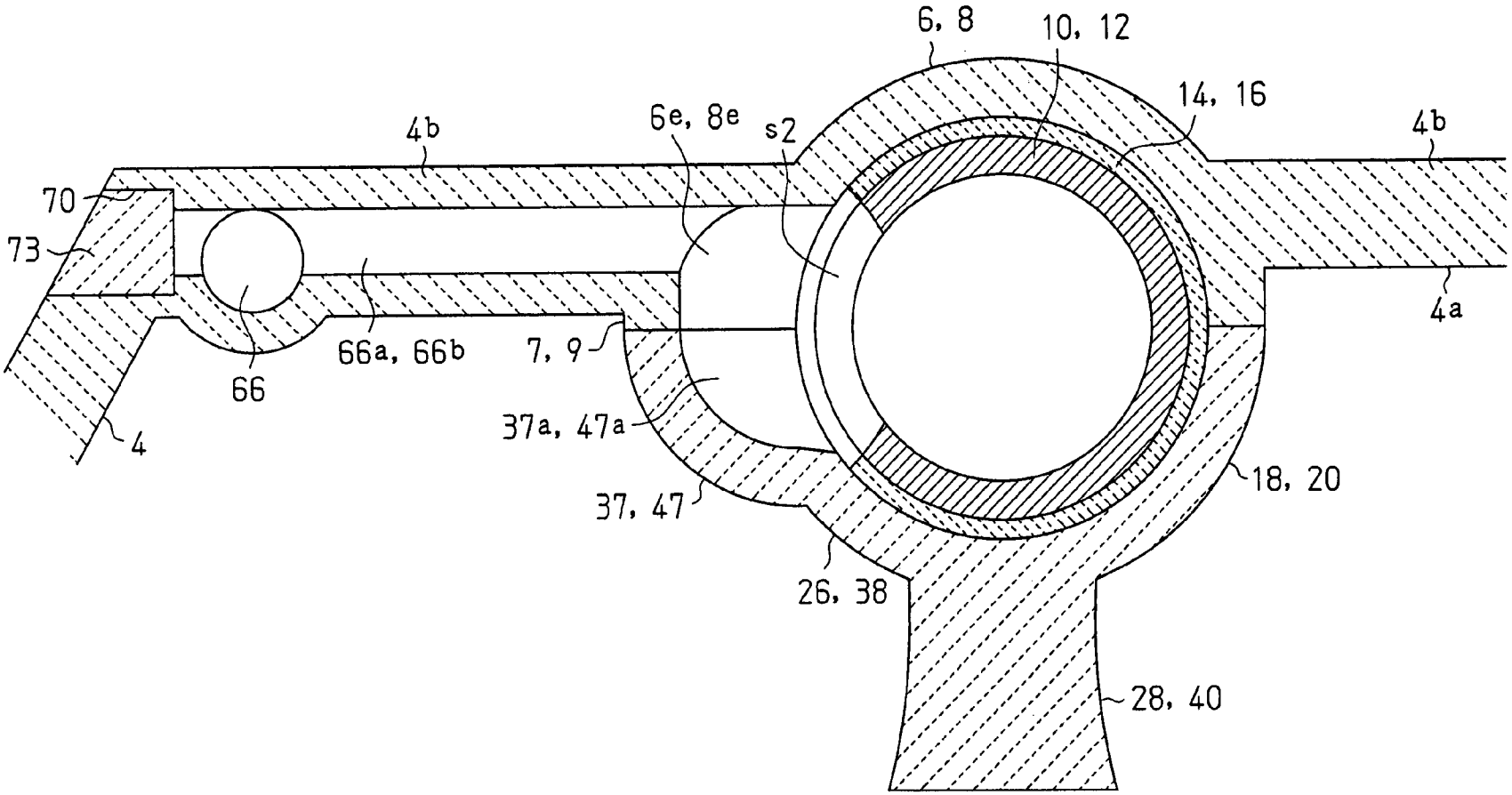
FIG. 7 is a longitudinal cross-sectional view illustrating a hydraulic pressure supplying passage according to the first embodiment.

As shown in FIG. 7, the supply recesses 6*e*, 8*e* in the projections 7, 9 of the cradles 6, 8 receive hydraulic pressure from the interior of the top surface 4*b* of the cylinder head cover main body 4, particularly from a hydraulic pressure supplying channel 66 and the distribution channels 66*a*, 66*b*, which channels 66, 66*a*, 66*b* are formed to extend on and project from the inner surface 4*a*. The supply recesses 37*a*, 47*a* in the projections 37, 47 of the resin caps 18, 20, which are connected to the supply recesses 6*e*, 8*e*, also receive hydraulic pressure.

Figure 8:
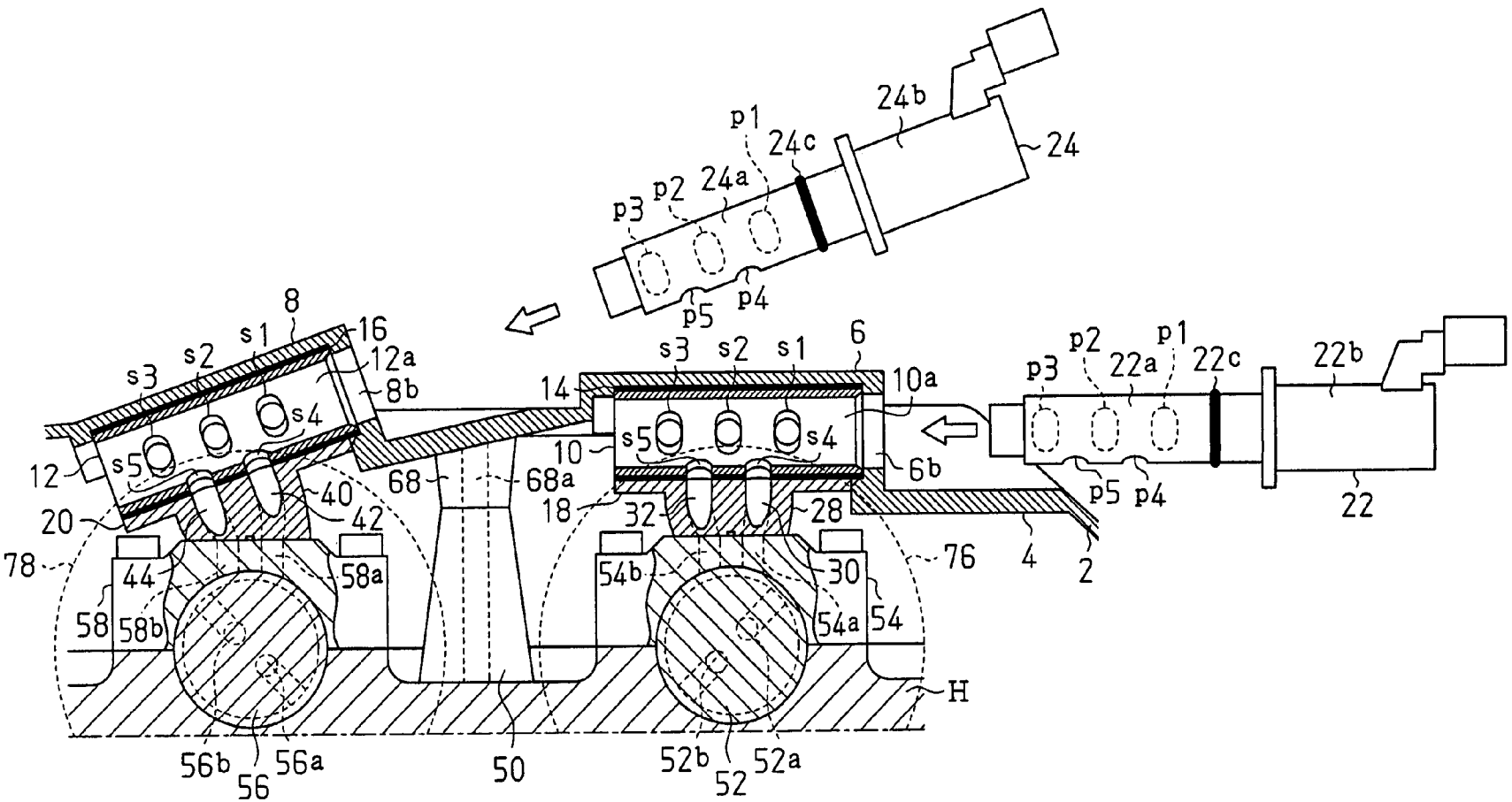
FIG. 8 is a longitudinal cross-sectional view illustrating the arrangement of the resin cylinder head cover and the cylinder head of the first embodiment.

As shown in FIG. 2, the hydraulic pressure supplying channel 66 receives hydraulic pressure from a hydraulic pressure supply passage 68*a* in a hydraulic connector 68, which projects into the inner surface of the cylinder head cover main body 4, through a hydraulic pressure supplying channel 67. When the resin cylinder head cover 2 is attached to the cylinder head H as shown in FIG. 8, the hydraulic pressure supply passage 68*a* of the hydraulic connector 68 is connected to a hydraulic pressure supplying portion 50 in the cylinder head H. Accordingly, hydraulic pressure is supplied from the hydraulic connector 68 to the hydraulic pressure supplying channel 66. The oil holes s2 of the sleeves 10, 12 are thus supplied with hydraulic pressure.

The hydraulic pressure supplying channels 66, 67 and the distribution channels 66*a*, 66*b* are formed when the resin cylinder head cover main body 4 is formed by integral molding. The channels 66, 67, 66*a*, 66*b* are formed by using core pins. As the core pins, three small-diameter core pins and one large-diameter core pin are prepared. The small core pins correspond to the hydraulic pressure supplying channel 67 and the distribution channels 66*a*, 66*b*. The large-diameter core pin corresponds to the hydraulic pressure supplying channel 66 and has cavities corresponding to the small-diameter core pins.

For example, the three small-diameter core pins and the single large-diameter core pin are placed in a mold and arranged according the arrangement of the channels, and the cylinder head cover main body 4 is injection molded with resin. After the resin is hardened, the three core pins are removed from the distribution channels 66*a*, 66*b* and the hydraulic pressure supplying channel 67, and the large-diameter core pin is removed from the hydraulic pressure supplying channel 66. Thereafter, opening portions 70 (FIG. 7) and 72 (outer shape is shown in FIGS. 1 and 2) of the hydraulic pressure supplying channel 66, the distribution channels 66*a*, 66*b*, and the hydraulic pressure supplying channel 67 are closed with resin plugs 73 as shown in FIG. 7.

The assemblies of the sleeves 10, 12 and cylindrical gaskets 14, 16 are placed on the cradles 6, 8 of the thus constructed cylinder head cover main body 4. Then, while pressing the resin caps 18, 20, the edges 26*a*, 38*a* of the resin caps 18, 20 are welded to the edges 6*a*, 8*a* of the cradles 6, 8. The resin cylinder head cover 2 is thus completed.

Accordingly, in the resin cylinder head cover 2, the oil holes s1, s3 of the first sleeve 10 are connected to the draining oil passages 60, 62. The oil hole s2 is connected to the distribution channel 66*a* via the supply recesses 6*e*, 37*a*. The oil hole s4 is connected to the intermediate oil passage 30 of the first resin cap 18, and the oil hole s5 is connected to the intermediate oil passage 32. The oil holes s1, s3 of the second sleeve 12 are connected to the draining oil passages 63, 64. The oil hole s2 is connected to the distribution channel 66*b* via the supply recesses 8*e*, 47*a*. The oil hole s4 is connected to the intermediate oil passage 42, and the oil hole s5 is connected to the intermediate oil passage 44.

As shown in FIG. 8, the resin cylinder head cover 2 is fixed to the cylinder head H. Accordingly, the coupling portion 28 of the first resin cap 18 contacts the top surface of a cam cap 54 for the intake camshaft 52, so that the intermediate oil passage 30 is connected to a timing retarding oil passage 52*a* via a cam cap oil passage 54*a*, and the intermediate oil passage 32 is connected to a timing advancing oil passage 52*b* via a cam cap oil passage 54*b*. At this time, the gasket at the distal end of the coupling portion 28 seals hydraulic oil from leaking through the contacting surfaces. Accordingly, the oil hole s4 of the first sleeve 10, which is connected to the intermediate oil passage 30, is connected to the timing retarding oil passage 52*a*, and the oil hole s5 of the first sleeve 10, which is connected to the intermediate oil passage 32, is connected to the timing advancing oil passage 52*b*.

Further, the coupling portion 40 of the second resin cap 20 contacts the top surface of a cam cap 58 for the exhaust camshaft 56, so that the intermediate oil passage 42 is connected to a timing retarding oil passage 56*a* via a cam cap oil passage 58*a*, and the intermediate oil passage 44 is connected to a timing advancing oil passage 56*b* via a cam cap oil passage 58*b*. At this time, the gasket at the distal end of the coupling portion 40 seals hydraulic oil from leaking through the contacting surfaces. Accordingly, the oil hole s4 of the second sleeve 12, which is connected to the intermediate oil passage 42, is connected to the timing retarding oil passage 56*a*, and the oil hole s5 of the second sleeve 12, which is connected to the intermediate oil passage 44, is connected to the timing advancing oil passage 56*b*.

Therefore, hydraulic pressure can be supplied to the oil holes s2 of the sleeves 10, 12 from the hydraulic connector 68 through the hydraulic pressure supplying channels 67, 66 and the distribution channels 66*a*, 66*b*. The spool housings 22*a*, 24*a* of the OCVs 22, 24 are inserted into the mounting bores 10*a*, 12*a* of the sleeves 10, 12 arranged in the cradles 6, 8 through the insertion opening portions 6*b*, 8*b*. The spool housings 22*a*, 24*a* are fixed to the cylinder head cover main body 4, for example, with bolts. Accordingly, the ports p1 to p5 of the OCVs 22, 24 are connected to the oil holes s1 to s5 of the sleeves 10, 12. In this manner, the OCVs 22, 24 are installed as shown in FIG. 3.

The OCVs 22, 24 are mounted as described above, and an electronic control unit (ECU) 74 controls exciting current to solenoid sections 22*b*, 22*b* of the OCVs 22, 24 in accordance with the operating state of the engine. This permits the hydraulic pressure supplied to the ports p2 of the spool housings 22*a*, 24*a* from the hydraulic pressure supplying channels 67, 66 and the distribution channels 66*a*, 66*b* through the oil hole s2 to be supplied to one of the oil holes s4, s5 and discharged to the oil holes s1, s3 from the other one of the oil holes s4, s5. In this manner, the hydraulic pressure is supplied to and drained from the variable valve actuation mechanisms 76, 78 using the intermediate oil passages 30, 32, 42, 44, the cam cap oil passages 54*a*, 54*b*, 58*a*, 58*b*, and the oil passages 52*a*, 52*b*, 56*a*, 56*b* formed in the camshafts 52, 56. Accordingly, the valve timing of the intake valves and the valve timing of the exhaust valves are adjusted. In FIG. 8, the cylindrical gaskets 14, 16 are shown as solid filled portions.

The first embodiment has the following advantages.

(a) In the resin cylinder head cover 2, the hydraulic pressure supplying channels 66, 67 and the distribution channels 66*a*, 66*b*, which are resin oil passages for supplying oil to the OCVs 22, 24, are formed by integral molding of the same resin as that of the cylinder head cover main body 4. Since the hydraulic pressure supplying channels 66, 67 and the distribution channels 66*a*, 66*b* are completely integrated with and have high affinity for the cylinder head cover main body 4, the hydraulic pressure supplying channels 66, 67 and the distribution channels 66*a*, 66*b* are firmly fixed to the cylinder head cover main body 4. Therefore, special components, such as union bolts and oil joints, are not needed, and thus the number of the components is minimized.

Further, the hydraulic pressure supplying channels 66, 67 and the distribution channels 66*a*, 66*b* are firmly integrated with the cylinder head cover main body 4 by integral molding. Thus, the hydraulic pressure supplying channels 66, 67 and the distribution channels 66*a*, 66*b* are not raised from the surface of the resin cylinder head cover 2. This effectively prevents resonance due to the operation of the internal combustion engine, so that problems related to sealing of oil are solved. Accordingly, the operation of the variable valve actuation mechanisms 76, 78 is ensured.

Further, in the first embodiment, the hydraulic pressure supplying channels 66, 67 and the distribution channels 66*a*, 66*b* are formed to project into a space defined by the inner surface 4*a* of the cylinder head cover main body 4. This structure reduces the height of the resin cylinder head cover 2.

Second Embodiment

Figure 9:
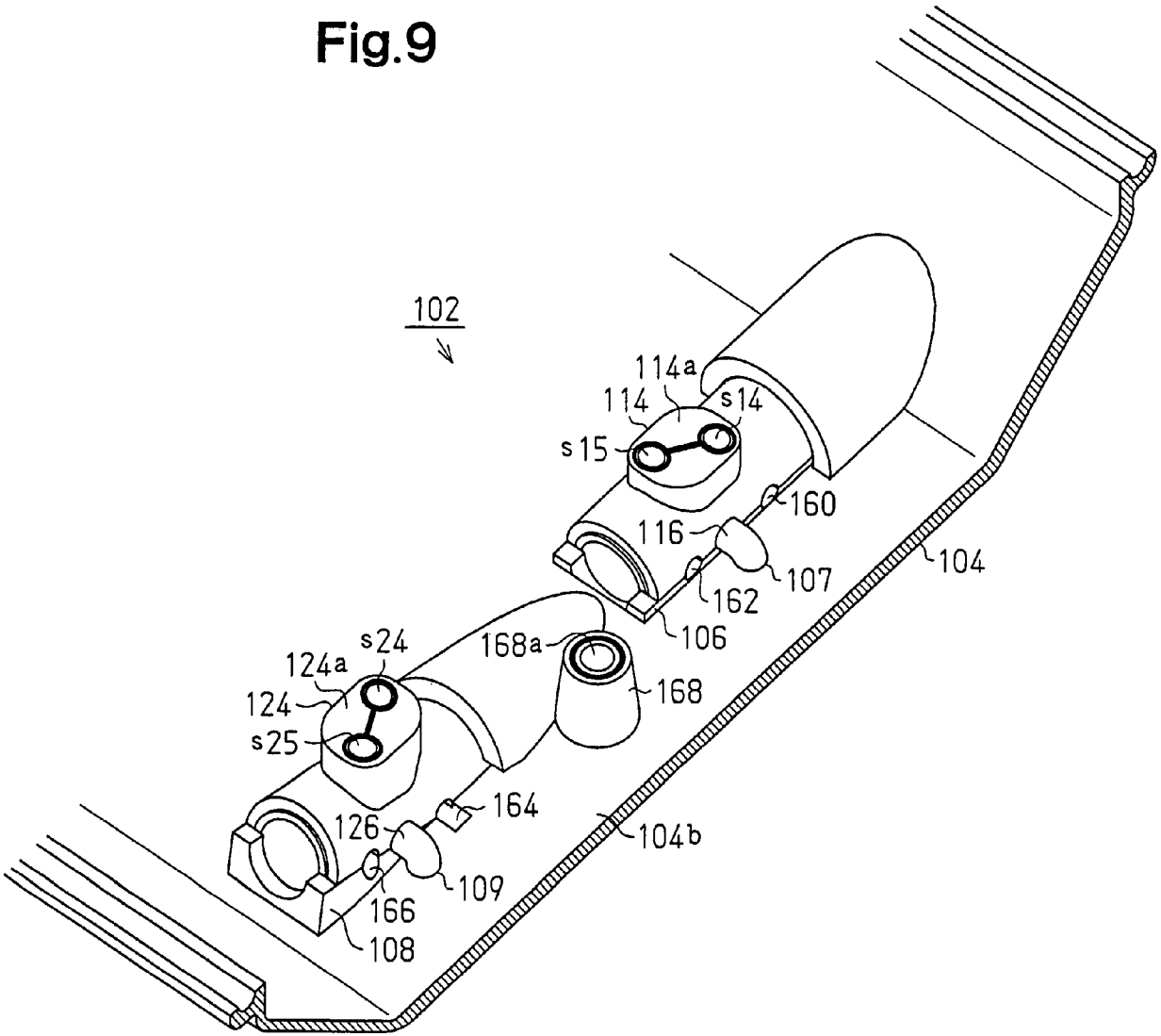
FIG. 9 is a perspective view illustrating the bottom of a resin cylinder head cover according to a second embodiment.
Figure 10:
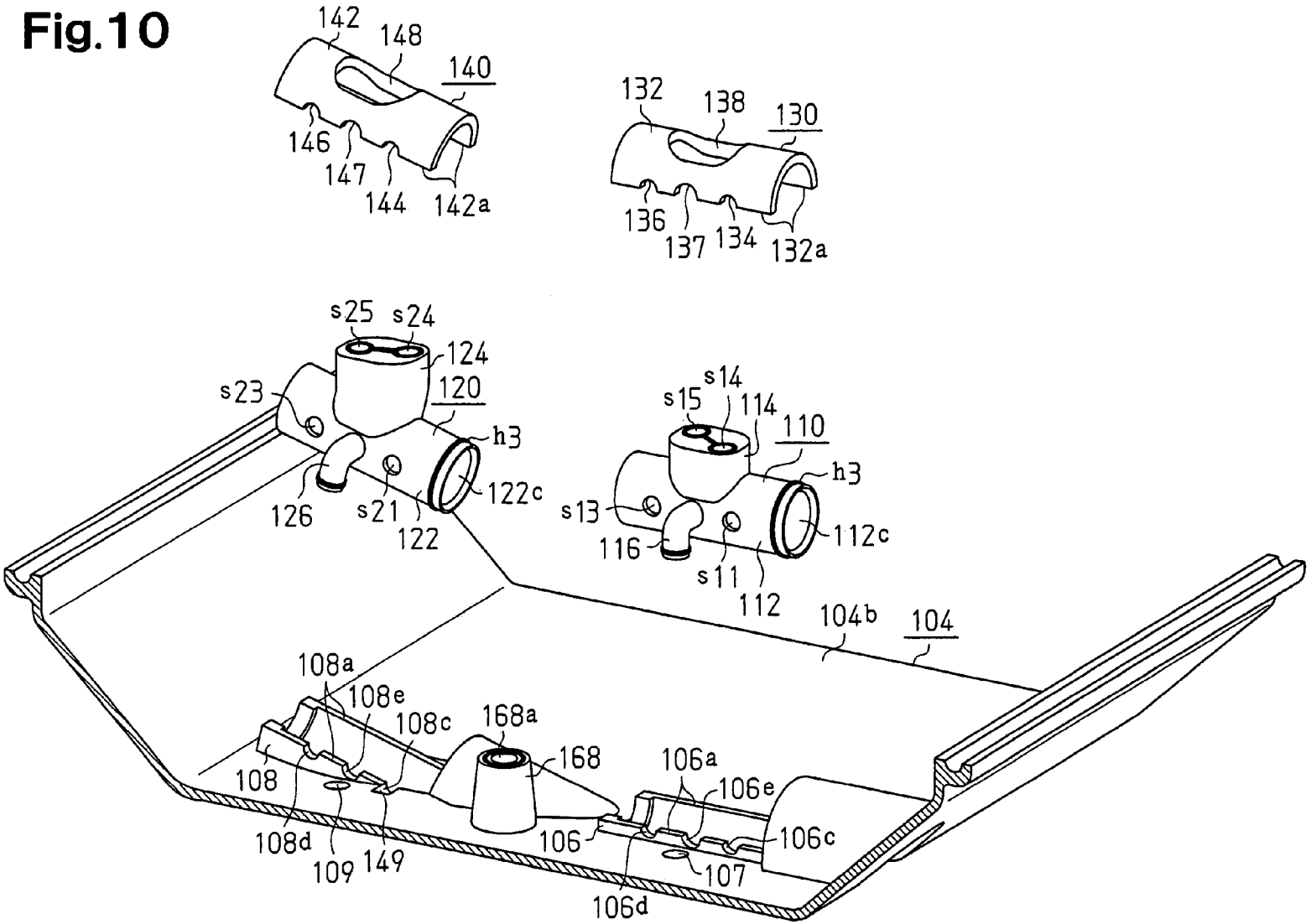
FIG. 10 is an exploded perspective view illustrating the resin cylinder head cover of the second embodiment.

The perspective view of FIG. 9 illustrates a main part of a resin cylinder head cover 102 according to a second embodiment. FIG. 10 is an exploded perspective view.

A first cradle 106 and a second cradle 108 are formed in a cylinder head cover main body 104. The cradles 106, 108 basically have the same shape as the cradles of the first embodiment. However, unlike the first embodiment, no projections are formed on edges 106*a*, 108*a* of the cradles 106, 108. Notches 106*c*, 106*d*, 108*c*, 108*d*, and pipe receiving grooves 106*e*, 108*e* for L-shaped hydraulic supplying pipes are formed at the corresponding positions. A draining recess 149 in the second cradle 108 is the same as that of the first embodiment.

Figure 11:
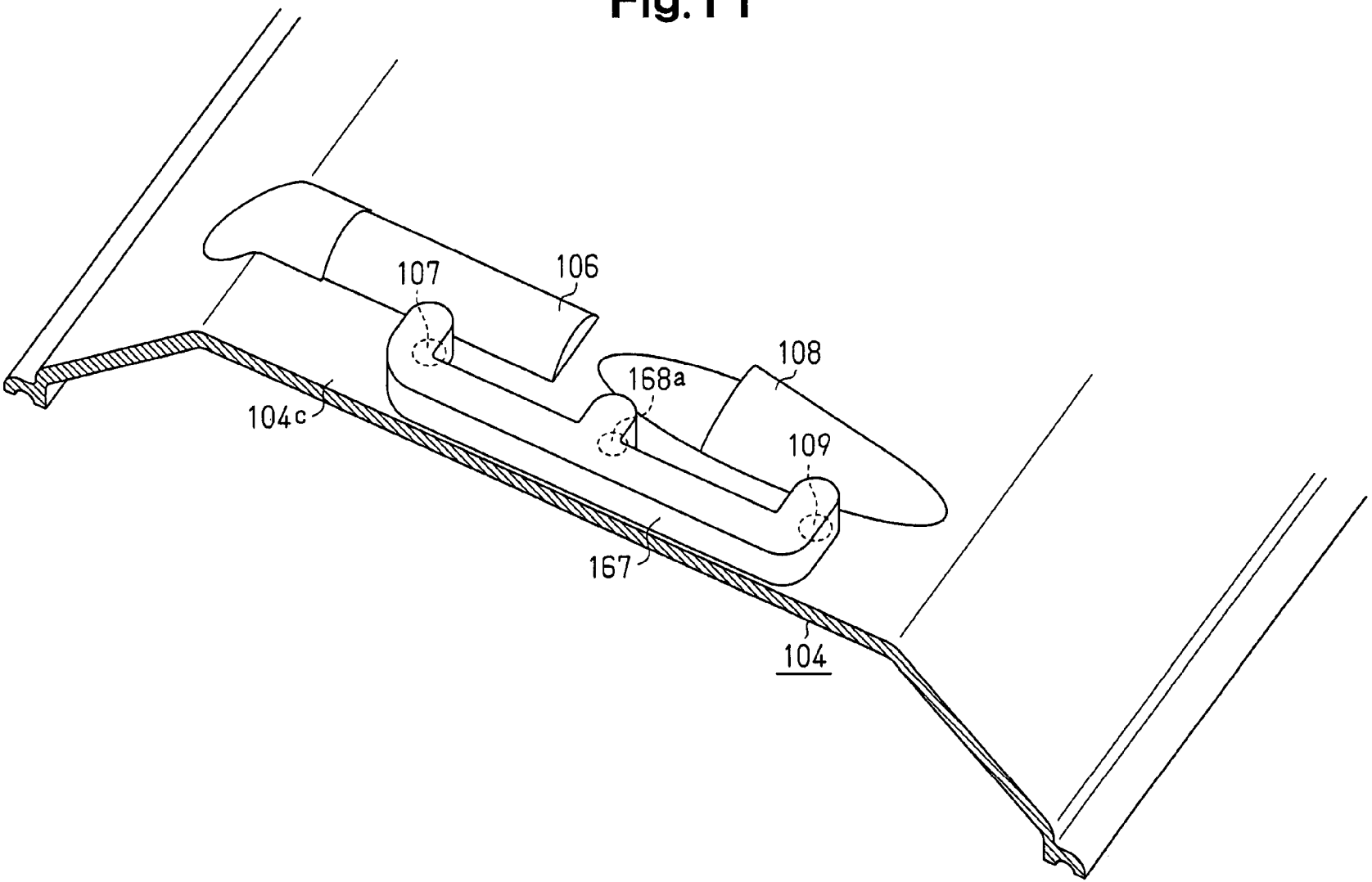
FIG. 11 is a perspective view illustrating the resin cylinder head cover of the second embodiment.

Further, the cylinder head cover main body 104 has pipe receiving holes 107, 109 located in the vicinity of the pipe receiving grooves 106*e*, 108*e*. As shown in FIG. 11, the pipe receiving holes 107, 109 are covered with an oil channel cover 167 on an outer surface 104*c* of the cylinder head cover main body 104, and are connected to a hydraulic pressure supply passage 168*a* in a hydraulic connector 168 via an oil passage in the oil channel cover 167. The oil channel cover 167 is formed of resin (the same resin as that of the cylinder head cover main body 104 in this embodiment) by integral molding.

Figure 12:
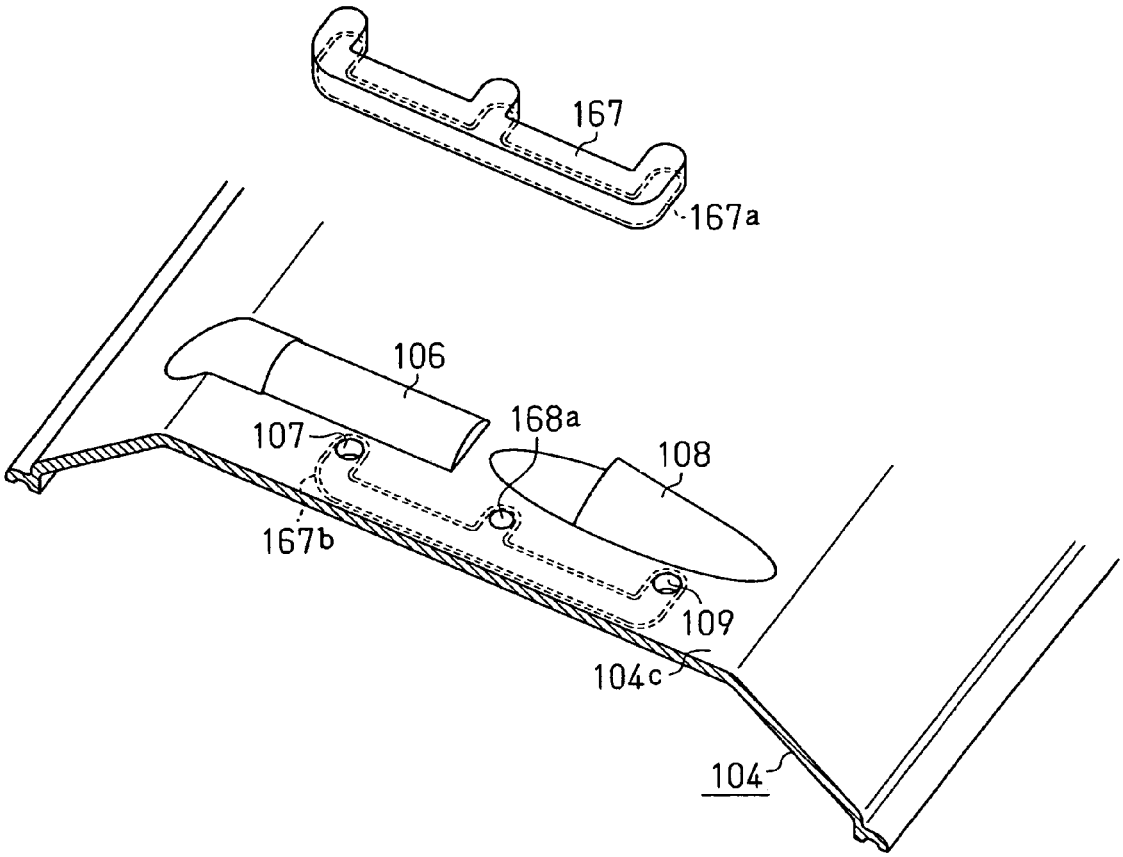
FIG. 12 is an exploded perspective view illustrating the resin cylinder head cover of the second embodiment.
Figure 13:
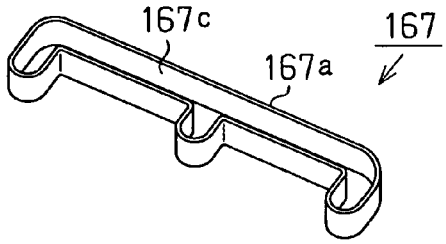
FIG. 13 is a perspective view illustrating the bottom of an oil channel cover according to the second embodiment.
Figure 14A:
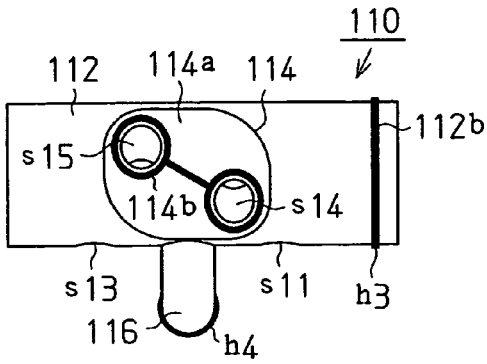
FIG. 14(A) is a plan view illustrating a first sleeve according to the second embodiment.
Figure 14D:
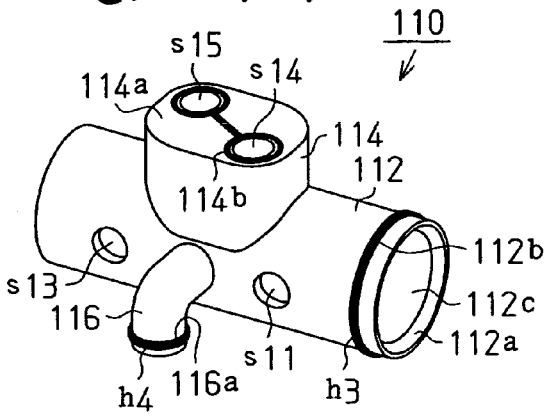
FIG. 14(D) is a perspective view illustrating the first sleeve of FIG. 14(A)
Figure 14B:
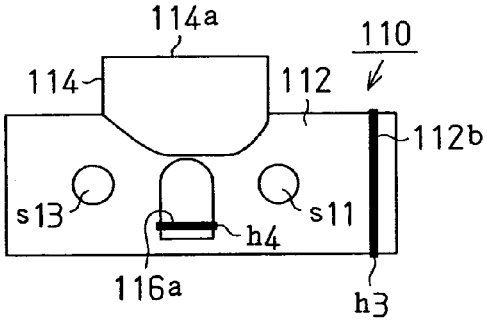
FIG. 14(B) is a front view illustrating the first sleeve of FIG. 14(A)
Figure 14E:
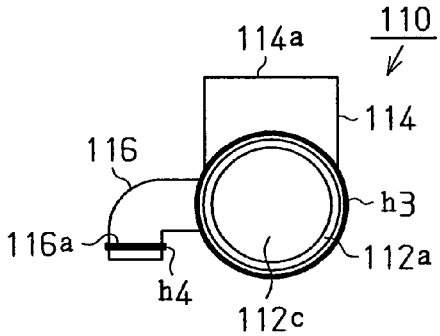
FIG. 14(E) is a right side view illustrating the first sleeve of FIG. 14(A)
Figure 14C:
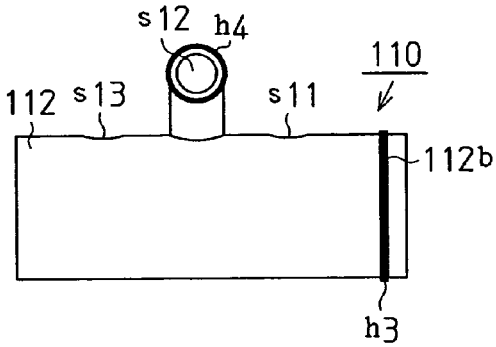
FIG. 14(C) is a bottom view illustrating the first sleeve of FIG. 14(A)
Figure 14F:
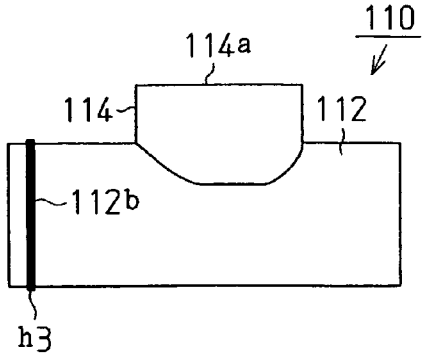
FIG. 14(F) is a rear view illustrating the first sleeve of FIG. 14(A)

As shown in the exploded perspective view of FIG. 12, the oil channel cover 167 is attached to a welding zone 167*b* on an outer surface 104*c* of the cylinder head cover main body 104 at a lower surface 167*a*. As shown in FIG. 13, in which the oil channel cover 167 is inverted, the interior of the oil channel cover 167 functions as a hydraulic pressure supply channel 167*c*. Since the oil channel cover 167 covers the outer surface 104*c* of the cylinder head cover main body 104, the hydraulic pressure supply channel 167*c* permits hydraulic pressure of the hydraulic pressure supply passage 168*a* in the hydraulic connector 168 to be supplied to the pipe receiving holes 107, 109.

FIG. 14 illustrates a first sleeve 110 accommodated in the first cradle 106. FIG. 14(A) is a plan view, FIG. 14(B) is a front view, FIG. 14(C) is a bottom view, FIG. 14(D) is a perspective view, FIG. 14(E) is a right side view, and FIG. 14(F) is a rear view. The first sleeve 110 includes a sleeve main body 112, a coupling portion 114 and an L-shaped hydraulic pressure supplying pipe 116. The sleeve main body 112 is formed as a cylinder with both ends open. A tapered surface 112*a* is formed on the inner circumferential surface of one distal end of the sleeve main body 112. The tapered surface 112*a* functions to facilitate the attachment of an OCV. At the same distal end, an O-ring groove 112*b* is formed on the outer circumferential surface, and an O-ring h3 is arranged in the O-ring groove 112*b*. A mounting bore 112*c*, which is an interior, is formed to receive an OCV.

The sleeve main body 112 has five oil holes s11, s12, s13, s14, s15. Three of the five oil holes, or the oil holes s11, s12, s13, are arranged along the axial direction in a middle section with respect to the vertical direction. The oil holes s11, s13 on the sides communicate with the outside through the mounting bore 112*c*. The oil hole s12 at the center extends from the mounting bore 112*c* through a downwardly bent space in the L-shaped hydraulic pressure supplying pipe 116, and is open to the outside at the distal end of the L-shaped hydraulic pressure supplying pipe 116. An O-ring groove 116*a* is formed on the outer circumferential surface of the distal end of the L-shaped hydraulic pressure supplying pipe 116. An O-ring h4 is arranged in the O-ring groove 116*a*.

The oil holes s14, s15, which are formed at the top of the sleeve main body 112, extend through the coupling portion 114. In the coupling portion 114, the oil holes s14, s15 are either curved or formed linearly in a slanted manner, and reach a contact surface 114*a* of the coupling portion 114 while being displaced from each other with respect to a circumferential direction of the sleeve main body 112. A gasket 114*b* is located on the contact surface 114*a* to surround the oil holes s14, s15. The gasket 114*b* is only illustrated in FIGS. 14(A) and 14(D).

Figure 15:
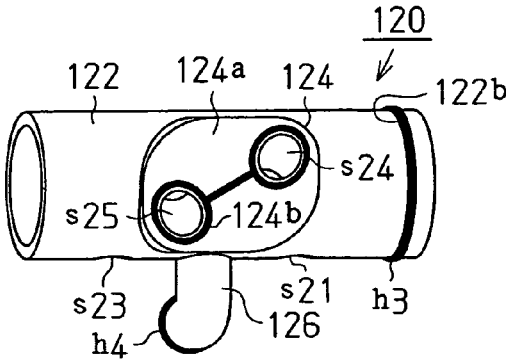
FIG. 15(A) is a plan view illustrating a second sleeve according to the second embodiment.
FIG. 15(B) is a front view illustrating the second sleeve of FIG. 15(A)
FIG. 15(C) is a bottom view illustrating the second sleeve of FIG. 15(A)
FIG. 15(D) is a perspective view illustrating the second sleeve of FIG. 15(A)
FIG. 15(E) is a left side view illustrating the second sleeve of FIG. 15(A)
FIG. 15(F) is a rear view illustrating the second sleeve of FIG. 15(A)
Figure 15:
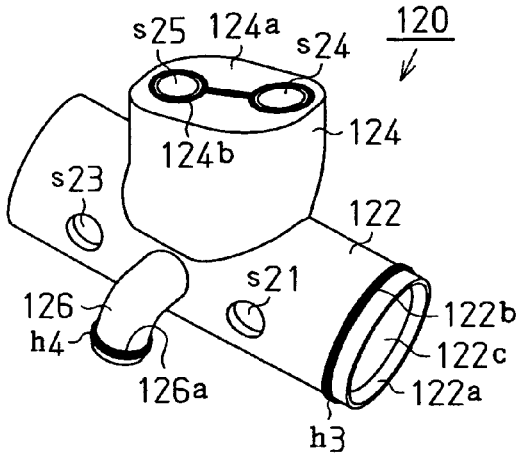
Figure 15:
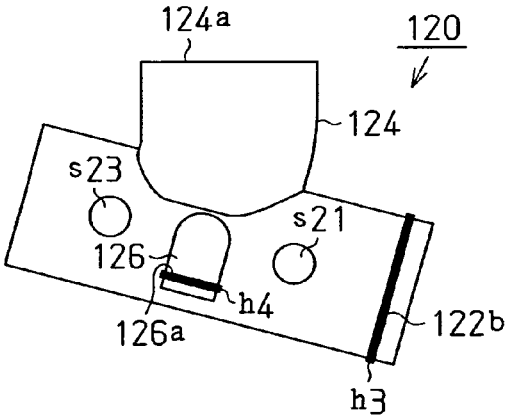
Figure 15:
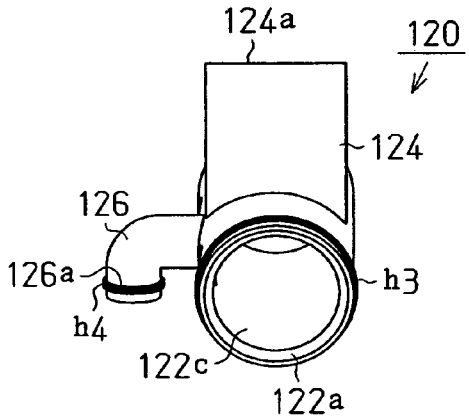
Figure 15:
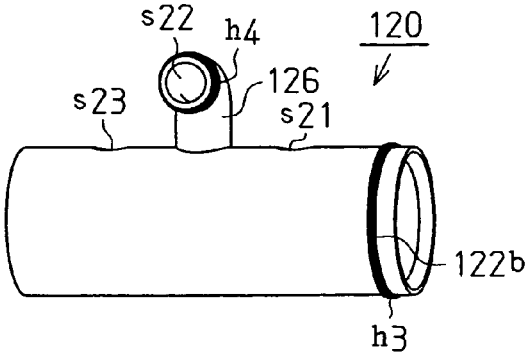
Figure 15:
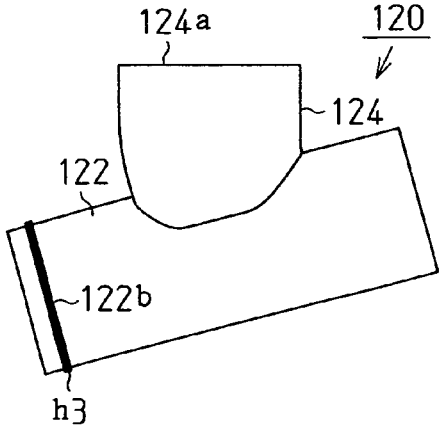

FIG. 15 illustrates a second sleeve 120 accommodated in the second cradle 108. FIG. 15(A) is a plan view, FIG. 15(B) is a front view, FIG. 15(C) is a bottom view, FIG. 15(D) is a perspective view, FIG. 15(E) is a right side view, and FIG. 15(F) is a rear view. The second sleeve 120 is basically the same as the first sleeve 110, and includes a sleeve main body 122, a coupling portion 124, and an L-shaped hydraulic pressure supplying pipe 126. The sleeve main body 122 is formed as a cylinder with both ends open. A tapered surface 122*a* is formed on the inner circumferential surface of one distal end of the sleeve main body 122. The tapered surface 122*a* functions to facilitate the attachment of an OCV. At the same distal end, an O-ring groove 122*b* is formed on the outer circumferential surface, and an O-ring h3 is arranged in the O-ring groove 122*b*. A mounting bore 122*c*, which is an interior, is formed to receive an OCV.

The sleeve main body 122 has five oil holes s21, s22, s23, s24, s25. Three of the five oil holes, or the oil holes s21, s22, s23, are arranged along the axial direction in a middle section with respect to the vertical direction. The oil holes s21, s23 on the sides communicate with the outside through the mounting bore 122*c*. The oil hole s22 at the center extends from the mounting bore 122*c* through a downwardly bent space in the L-shaped hydraulic pressure supplying pipe 126, and is open to the outside at the distal end of the L-shaped hydraulic pressure supplying pipe 126. An O-ring groove 126*a* is formed on the outer circumferential surface of the distal end of the L-shaped hydraulic pressure supplying pipe 126. An O-ring h4 is arranged in the O-ring groove 126*a*.

The oil holes s24, s25, which are formed at the top of the sleeve main body 122, extend through the coupling portion 124. In the coupling portion 124, the oil holes s24, s25 are either curved or formed linearly in a slanted manner, and reach a contact surface 124*a* of the coupling portion 124 while being displaced from each other with respect to a circumferential direction of the sleeve main body 122. The oil holes s24, s25 are displaced in a direction opposite to the direction in which the oil holes s14, s15 of the first sleeve 110 are displaced. A gasket 124*b* is located on the contact surface 124*a* to surround the oil holes s24, s25. The gasket 124*b* is only illustrated in FIGS. 15(A) and 15(D).

As shown in FIGS. 9 and 10, the second sleeve 120 is arranged such that the axial direction of the sleeve main body 122 is inclined relative to a top surface 104*b*. Thus, when the second sleeve 120 is located in the second cradle 108, the contact surface 124*a* of the coupling portion 124 is inclined relative to the axial direction of the sleeve main body 122 such that the contact surface 124*a* lies in the same plane as the contact surface 114*a* of the coupling portion 114 of the first sleeve 110.

Figure 16:
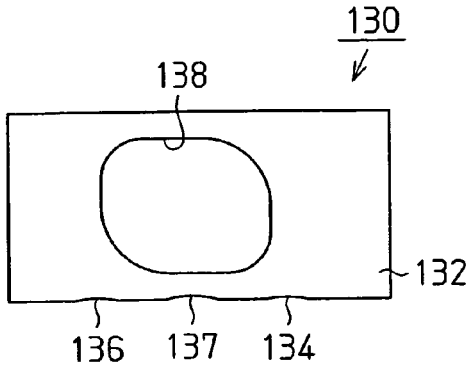
FIG. 16(A) is a plan view illustrating a first resin cap according to the second embodiment.
FIG. 16(B) is a front view illustrating the first resin cap of FIG. 16(A)
FIG. 16(C) is a bottom view illustrating the first resin cap of FIG. 16(A)
FIG. 16(D) is a perspective view illustrating the first resin cap of FIG. 16(A)
FIG. 16(E) is a right side view illustrating the first resin cap FIG. 16(A)
FIG. 16(F) is a rear view illustrating the first resin cap of FIG. 16(A)
Figure 16:
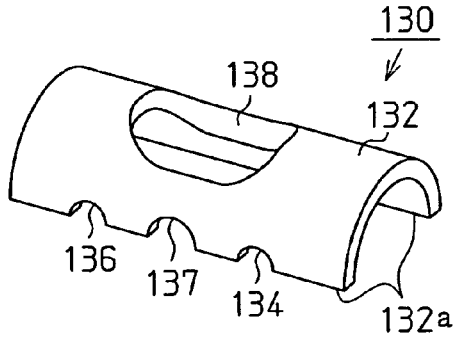
Figure 16:
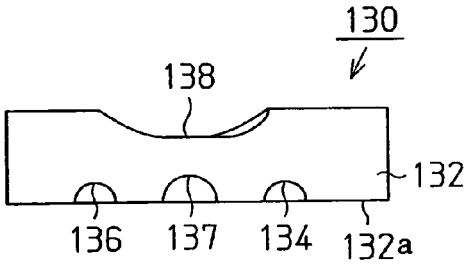
Figure 16:
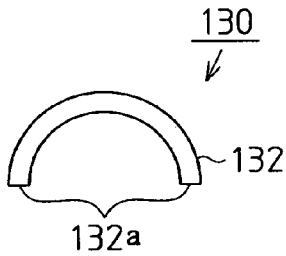
Figure 16:
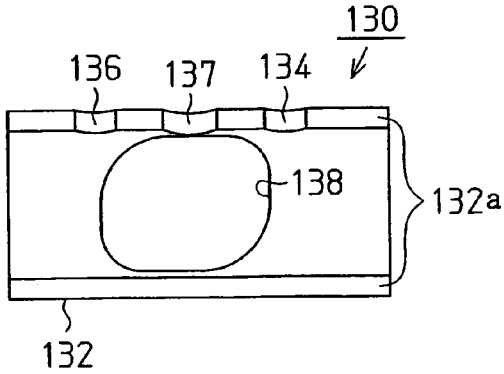
Figure 16:
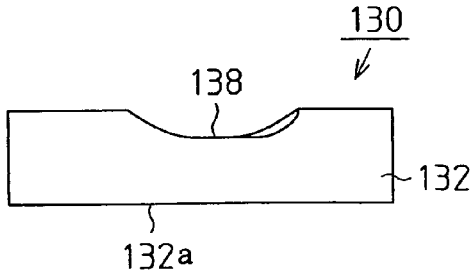

Resin caps 130, 140 for fixing the sleeves 110, 120 to the cradles 106, 108 will now be described. FIGS. 16(A) to 16(F) illustrate the first resin cap 130. FIG. 16(A) is a plan view, FIG. 16(B) is a front view, FIG. 16(C) is a bottom view, FIG. 16(D) is a perspective view, FIG. 16(E) is a right side view, and FIG. 16(F) is a rear view.

The first resin cap 130 is made of resin (the same resin as that of the cylinder head cover main body 104 in this embodiment) and is formed by integral molding. The first resin cap 130 is mainly composed of a semi-cylindrical main body 132. Two semi-circular notches 134, 136 are formed in one of edges 132*a* of the cap main body 132. When the edges 132*a* of the first resin cap 130 are welded to the edges 106*a* of the first cradle 106, the notches 134, 136 form draining oil passages 160, 162 (FIG. 9) together with notches 106*c*, 106*d* formed in one of the edges 106*a*. The draining oil passages 160, 162 correspond to the oil holes s11, s13 of the first sleeve 110, and drain hydraulic oil to the interior of the resin cylinder head cover 102.

A semi-circular pipe receiving groove 137 is formed between the two notches 134, 136. The pipe receiving groove 137, together with the pipe receiving groove 106*e* formed in the edge 106*a* of the first cradle 106, receives the L-shaped hydraulic pressure supplying pipe 116 of the first sleeve 110.

An opening portion 138 is formed in a top portion of the cap main body 132. The coupling portion 114 of the first sleeve 110 passes through the opening portion 138.

Figure 17:
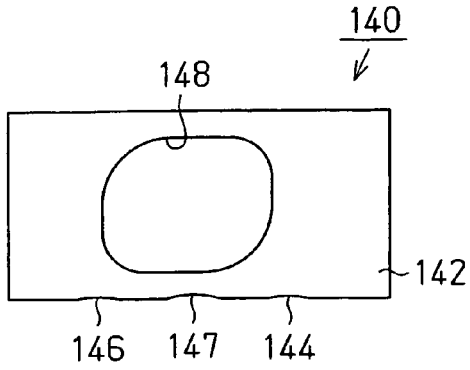
FIG. 17(A) is a plan view illustrating a second resin cap according to the second embodiment.
FIG. 17(B) is a front view illustrating the second resin cap of FIG. 17(A)
FIG. 17(C) is a bottom view illustrating the second resin cap of FIG. 17(A)
FIG. 17(D) is a perspective view illustrating the second resin cap of FIG. 17(A)
FIG. 17(E) is a right side view illustrating the second resin cap FIG. 17(A)
FIG. 17(F) is a rear view illustrating the second resin cap of FIG. 17(A)
Figure 17:
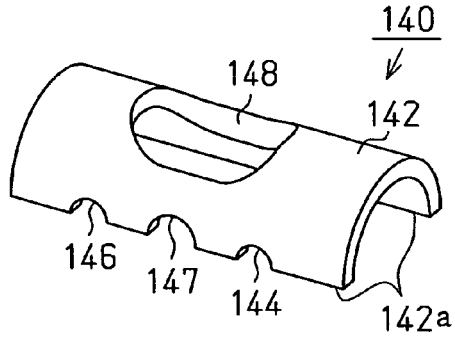
Figure 17:
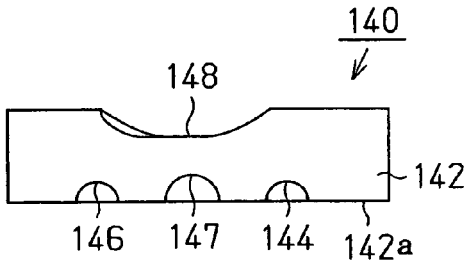
Figure 17:
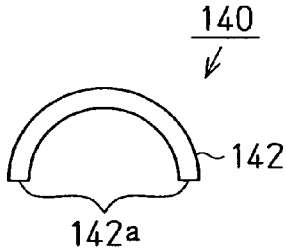
Figure 17:
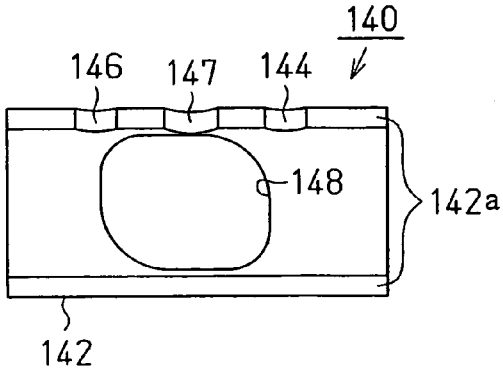
Figure 17:
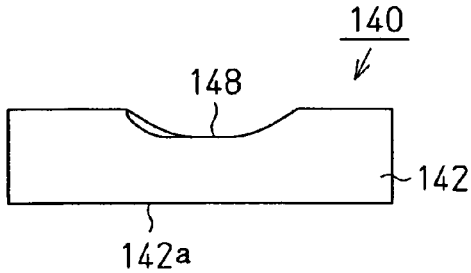

FIGS. 17(A) to 17(F) illustrate the second resin cap 140. FIG. 17(A) is a plan view, FIG. 17(B) is a front view, FIG. 17(C) is a bottom view, FIG. 17(D) is a perspective view, FIG. 17(E) is a right side view, and FIG. 17(F) is a rear view.

The second resin cap 140 is made of resin (the same resin as that of the cylinder head cover main body 104 in this embodiment) and is formed by integral molding. The shape of the second resin cap 140 is basically the same as that of the first resin cap 130. That is, the second resin cap 140 is mainly composed of a semi-cylindrical main body 142. Two semi-circular notches 144, 146 are formed in one of edges 142*a* of the cap main body 142. When the edges 142*a* of the second resin cap 140 are welded to the edges 108*a* of the second cradle 108, the notches 144, 146 form draining oil passages 164, 166 (FIG. 9) together with the draining recess 149 and notches 108*c*, 108*d* formed in one of the edges 108*a*. The draining oil passages 164, 166 correspond to the oil holes s21, s23 of the second sleeve 120, and drain hydraulic oil to the interior of the resin cylinder head cover 102.

A semi-circular pipe receiving groove 147 is formed between the two notches 144, 146. The pipe receiving groove 147, together with the pipe receiving groove 108*e* formed in the edge 108*a* of the second cradle 108, receives the L-shaped hydraulic pressure supplying pipe 126 of the second sleeve 120.

An opening portion 148 is formed in a top portion of the cap main body 142. The coupling portion 124 of the second sleeve 120 passes through the opening portion 138.

The above described first sleeve 110 and second sleeve 120 are both formed by machining aluminum alloy.

To complete the resin cylinder head cover 102, the oil channel cover 167 is first welded to the integrally molded cylinder head cover main body 104 as shown in FIG. 11. The sleeves 110, 120 are placed in the cradles 106, 108 of the cylinder head cover main body 104. At this time, the distal ends of the L-shaped hydraulic pressure supplying pipe 116, 126 are simultaneously fitted in the pipe receiving holes 107, 109.

The coupling portions 114, 124 of the sleeves 110, 120 are inserted into the opening portions 138, 148 of the resin caps 130, 140. Further, while pressing the O ring h3, the edges 132*a*, 142*a* of the resin caps 130, 140 are welded to the edges 106*a*, 108*a* of the cradles 106, 108. In this manner, the resin cylinder head cover 102 shown in FIG. 9 is completed.

In the resin cylinder head cover 102, the oil holes s11, s13 of the first sleeve 110 are connected to the draining oil passages 160, 162. Further, the oil hole s12 is connected to hydraulic pressure supply channel 167*c* in the oil channel cover 167 by the L-shaped hydraulic pressure supplying pipe 116 through the pipe receiving hole 107. The oil holes s14, s15, which extend through the coupling portion 114, are exposed to the interior of the resin cylinder head cover 102. Likewise, the oil holes s21, s23 of the second sleeve 120 are connected to the draining oil passages 164, 166. Further, the oil hole s22 is connected to the hydraulic pressure supply channel 167*c* in the oil channel cover 167 by the L-shaped hydraulic pressure supplying pipe 126 through the pipe receiving hole 109. The oil holes s24, s25, which extend through the coupling portion 124, are exposed to the interior of the resin cylinder head cover 102.

Like the case of the first embodiment shown in FIG. 8, the resin cylinder head cover 102 is fixed to the cylinder head H. Accordingly, the coupling portion 114 of the first sleeve 110 contacts the top surface of the cam cap 54 for the intake camshaft 52, so that the oil hole s14 is connected to the timing retarding oil passage 52*a* via the cam cap oil passage 54*a*, and the oil hole s15 is connected to the timing advancing oil passage 52*b* via the cam cap oil passage 54*b*. At this time, the gasket 114*b* at the distal-end of the coupling portion 114 seals hydraulic oil from leaking through the contacting surfaces. Further, in the same manner, the coupling portion 124 of the second sleeve 120 contacts the top surface of the cam cap 58 for the exhaust camshaft 56, so that the oil hole s24 is connected to the timing retarding oil passage 56*a* via the cam cap oil passage 58*a*, and the oil hole s25 is connected to the timing advancing oil passage 56*b* via the cam cap oil passage 58*b*. At this time, the gasket 124*b* at the distal end of the coupling portion 124 seals hydraulic oil from leaking through the contacting surfaces.

Since the hydraulic pressure supply passage 168*a* of the hydraulic connector 168 is connected to the hydraulic pressure supplying portion 50 of the cylinder head H, hydraulic pressure supplied from the cylinder head H can be supplied to the oil holes s12, s22 through the hydraulic pressure supply passage 168*a* of the hydraulic connector 168 and the hydraulic pressure supply channel 167*c* in the oil channel cover 167.

The resin cylinder head cover 102 is attached to the cylinder head H in the above described manner. The spool housings 22*a*, 24*a* of the OCVs 22, 24 are inserted into the mounting bore 112*c*, 122*c* of the sleeves 110, 120 located in the cradles 106, 108 of the resin cylinder head cover 102 in the same manner as the case shown in FIG. 8. The OCVs 22, 24 are then fixed to the cylinder head cover main body 104, for example, with bolts. Attachment of the OCVs 22, 24 to the cylinder head cover main body 104 permits the ports p1 to p5 of the OCVs 22, 24 to be connected to the oil holes s11 to s15 and the oil holes s21 to s25 as in the first embodiment.

The ECU controls the thus installed OCVs 22, 24 to adjust supply and drainage of hydraulic pressure between the oil holes s14, s24 and the oil holes s15, s25, thereby adjusting the valve timing of the intake valves and the valve timing of the exhaust valves.

The second embodiment has the following advantage.

(a) The resin cylinder head cover 102 is configured such that the hydraulic pressure supply channel 167*c* supplies hydraulic pressure to the oil holes s12, s22 of the sleeves 110, 120. The resin oil channel cover 167 is welded to and cover the outer surface 104*c* of the cylinder head cover main body 104. Therefore, the hydraulic pressure supply channel 167*c* is completely integrated with the resin cylinder head cover 102. Thus, unlike Japanese Patent No. 3525709, the supply channel 167*c* does not need to be attached to and supported by means of union bolts and oil joints.

Since the cylinder head cover main body 104 and the oil channel cover 167, which define the sealed hydraulic pressure supply channel 167*c*, are both made of resin, the head cover main body 104 and the oil channel cover 167 have a high flexibility of the design in molding and a high affinity for each other. Accordingly, the resin components for the resin oil passages such as the oil channel cover 167, which defines the shape of the hydraulic pressure supply channel 167*c*, are formed into an arbitrary shape to be attached to the cylinder head cover main body 104 so that the components are firmly integrated with the resin cylinder head cover main body 104.

Thus, the resin oil passage are formed in the cylinder head cover main body 104 only by means of the oil channel cover 167, and no special parts such as union bolts and oil joints are necessary. Accordingly, the number of components is reduced. Further, since the oil channel cover 167 is in close contact with and firmly fixed to the cylinder head cover main body 104, resonance due to the operation of internal combustion engine is effectively prevented. The problems related to sealing of oil are thus solved. Accordingly, the operation of the variable valve actuation mechanisms is ensured.

Modified Embodiments (a) In the first embodiment (FIGS. 1 to 8), the hydraulic pressure supplying channels 66, 67 and the distribution channels 66*a*, 66*b* are formed by using core pins. However, the channels 66, 67, 66*a*, 66*b* may be-formed by using cores. Alternatively, the channels 66, 67, 66*a*, 66*b* may be partially machined by means of a drill.

Figure 18:
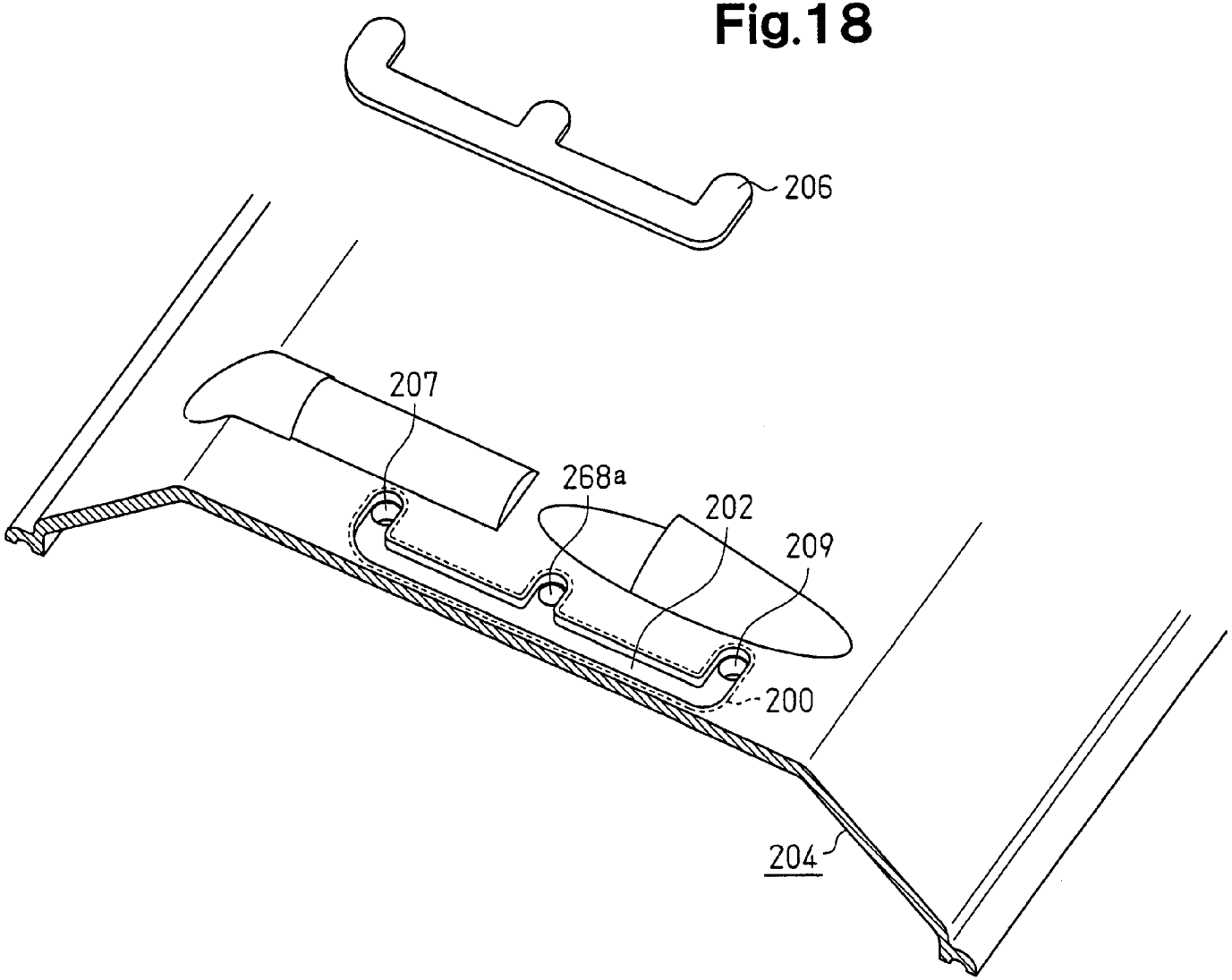
FIG. 18 is an exploded perspective view illustrating a resin cylinder head cover.

(b) In the second embodiment (FIGS. 9 to 17), the flat surface of the cylinder head cover main body 104 is used as the welding zone 167*b* of the cylinder head cover main body 104, to which the lower surface 167*a* of the oil channel cover 167 is welded. Instead, as shown in FIG. 18, a groove 202 may be formed inside a welding zone 200, and a hydraulic pressure supply channel may be defined in a cylinder head cover main body 204. Accordingly, an oil channel cover 206 is formed as a flat plate. By welding the flat oil channel cover 206 to the welding zone 200, hydraulic pressure can be supplied to pipe receiving holes 207, 209 from a hydraulic pressure supply passage 268*a* of a hydraulic connector.

Further, the oil channel cover 167 shown in FIG. 13, in which the hydraulic pressure supply channel 167*c* is formed, may be combined with cylinder head cover main body 204 shown in FIG. 18, in which the groove 202 is formed, so that a hydraulic pressure supply channel having a cross-sectional area is defined the channel 167*c* and the groove 202.

(c) In the illustrated embodiments, a resin cap is welded to a cradle. However, a resin cap may be fixed to a cradle by some other attaching method. For example, an adhesive may be used. Alternatively, welding may be performed while at the same time using adhesive. The same applies to the attachment between an oil channel cover and a cylinder head cover main body.

(d) In the illustrated embodiments, the first cradles are shown in a horizontal position. However, a resin cylinder head cover may be placed on a cylinder head such that the distal end of an OCV attached to the first cradle, that is, a portion of the OCV closer to a spool housing, is inclined downward with respect to the horizontal plane. When the distal end of the OCV is inclined downward, the hydraulic oil that slightly leaks from the clearance between the mounting bore and the spool housing is more reliably drained into the cylinder head cover. Further, hydraulic oil that leaks from the clearance between the sleeve and the cradle and from the clearance between the sleeve and the resin cap is readily discharged to the cylinder head cover in the same manner.

(e) In the illustrated embodiments, the resin cap is attached to the edges of the cradles. However, as long as the sleeve is fixed with the inner circumferential surface of the resin cap firmly pressed against the cylindrical gasket and the O-ring, the resin cap may be attached to the cylinder head cover main body at a portion other than the edges of the cradle.

The invention claimed is:

1. A resin cylinder head cover for an internal combustion engine, comprising:

a resin cover main body; and a resin oil passage that is integrated with the cover main body, wherein at least part of the oil passage is delineated by and extends within a projecting portion of a planar surface of the cover main body, the projecting portion protruding from the planar surface, and the projecting portion and the oil passage extend along a portion of the planar surface in a direction parallel to the portion of the planar surface along which the projecting portion and the oil passage extend.

2. The cover according to claim 1, wherein the oil passage is formed of a resin that is the same as that forming the cover main body.

3. The cover according to claim 1, wherein at least part of the resin forming the cover main body forms the oil passage.

4. The cover according to claim 1, wherein the oil passage projects from an inner side of the cover main body.

5. The cover according to claim 1, wherein the oil passage is formed by a space defined in the cover main body.

6. The cover according to claim 5, wherein, when the cover main body is molded, the oil passage is formed by using a pin or a core, which is removed after the molding is completed.

7. The cover according to claim 1, wherein the oil passage is defined by a surface of the cover main body and a resin member, the resin member covering the surface of the cover main body with a space in between.

8. The cover according to claim 7, wherein the resin member is welded to the surface of the cover main body.

9. The cover according to claim 1, wherein the oil passage is defined by a groove formed on a surface of the cover main body and a resin member, the resin member covering the groove with a space in between.

10. The cover according to claim 9, wherein the resin member is welded to the surface of the cover main body.

11. The cover according to claim 1, wherein an oil control valve is attached to the cover, which control valve controls hydraulic pressure supplied to a variable valve actuation mechanism of the internal combustion engine, and wherein pressurized oil is supplied to the oil control valve through the oil passage.

12. The cover according to claim 1, wherein the projecting portion is formed on an inner surface of the cover main body.

13. The cover according to claim 1, wherein the projecting portion is formed on an outer surface of the cover main body.

14. A resin cylinder head cover for an internal combustion engine, comprising:

a resin cover main body; and a resin main oil passage that is integrated with the cover main body, wherein at least part of the oil passage is delineated by and extends within a projecting portion of a planar surface of the cover main body, the projecting portion protruding from the planar surface, and the projecting portion and the oil passage extend along a portion of the planar surface in a direction parallel to the portion of the planar surface along which the the projecting portion and the oil passage extend, and wherein an oil control valve is attached to the cover, the control valve controls hydraulic pressure supplied to a variable valve actuation mechanism of the internal combustion engine; and pressurized oil is supplied to the oil control valve through the main oil passage, the main oil passage being connected to a connector oil passage in a hydraulic connector projecting from an inner surface of the cover main body, the connector oil passage being connected to a hydraulic pressure supplying portion provided in a cylinder head of the engine.

15. The cover according to claim 14, wherein the variable valve actuation mechanism is used for an intake valve;

the engine further includes another variable actuation mechanism used for an exhaust valve;

the oil control valve is used in the variable valve actuation mechanism for the intake valve, and another oil control valve is used in the variable valve actuation mechanism for the exhaust valve; and the main oil passage branches off the connector oil passage and supplies hydraulic pressure to the oil control valves.

* * * * *